United States Patent [19]

Honma

[11] 3,982,907

[45] Sept. 28, 1976

[54] HEAT AND WEAR RESISTANT SINTERED ALLOY

[75] Inventor: Uichi Honma, Kawagoe, Japan

[73] Assignee: Nippon Piston Ring Co., Ltd., Tokyo, Japan

[22] Filed: Oct. 31, 1974

[21] Appl. No.: 519,709

Related U.S. Application Data

[62] Division of Ser. No. 343,991, March 22, 1973, abandoned.

[30] Foreign Application Priority Data

Mar. 30, 1972 Japan ..... 47-31141

[52] U.S. Cl. ..... 29/182.7; 29/182.8; 75/126 A; 75/126 C; 75/126 H

[51] Int. Cl.[2] ..... C22C 1/05; C22C 29/00

[58] Field of Search ..... 29/182.7, 182.8, 182; 75/126 H, 126 A, 126 C

[56] References Cited

UNITED STATES PATENTS

| | | | |
|---|---|---|---|
| 2,562,543 | 7/1951 | Gippert | 75/126 H X |
| 3,661,658 | 5/1972 | Oda et al. | 75/126 H X |
| 3,758,281 | 9/1973 | Motoyoshi et al. | 29/182 |
| 3,793,691 | 2/1974 | Takahashi et al. | 29/182 |
| 3,795,961 | 3/1974 | Takahashi et al. | 29/182 |
| 3,863,318 | 2/1975 | Niimi et al. | 29/182 |

*Primary Examiner*—Richard E. Schafer
*Attorney, Agent, or Firm*—Sughrue, Rothwell, Mion, Zinn and Macpeak

[57] ABSTRACT

A heat and wear resistant sintered alloy produced by compacting and sintering a powdery mixture comprising, in percent by weight, C:0.2 – 2.0%, Cr:2.0 – 9.9%, Mo:0.3 – 1.5%, Co:3.0 – 10.0%, W:0.5 – 5.0% with the balance, totaling 100 wt.%, being substantially Fe.

1 Claim, 2 Drawing Figures

HEAT AND WEAR RESISTANT SINTERED ALLOY

This is a division of application Ser. No. 343,991 filed Mar. 22, 1973, now abandoned.

BACKGROUND OF THE INVENTION

1. Field of the Invention

This invention relates to a sintered alloy suitable for structural members required to have the high heat and wear resistance, such as valve seats for internal combustion engines (especially those actuated by the lead free gasoline).

2. Description of the Prior Art

Recently, sintered alloys have been widely used for various machine parts, but sliding members made of a sintered alloy are not satisfactory; i.e. when operating conditions become severe, the sliding member formed of a sintered alloy is required to have high heat and wear resistances. On the other hand, the cost for the production of the sliding member must be reduced.

Intending to satisfy these requirements, sintered alloys of the wear resistant melts, such as Cr, Co, W, Mo, Ti and V, have been developed. These metals, however, have high melting points requiring high sintering temperatures and long sintering times. Besides, various defects, such as deformation or poor quality, are often observed in the resultant sintered products.

SUMMARY OF THE INVENTION

Therefore, this invention is intended to eliminate the above difficulties in the conventional sintered alloys and to provide an improved sintered alloy product having excellent heat and wear resistances by sintering a preliminarily prepared alloy powder under reduced sintering temperature and reduced sintering time.

The present invention aims at providing a sintered alloy having large thermal resistance and wear resistance suitable for a sliding element such as, for example a valve seat in which high thermal resistance and high wear resistance are required. It is, therefore, an object of the present invention to provide a sintered thermal and wear resistant alloy comprising, in percent by weight, 0.2 to 2.0% carbon, 2.0 to 9.9% chrome, 0.3 to 1.5% molybdenum, 3.0 to 10.0% cobalt, 0.5 to 5.0% tungsten with the balance, totaling 100 weight percent, being substantially Fe.

BRIEF EXPLANATION OF ACCOMPANIED DRAWINGS

Figure 1:
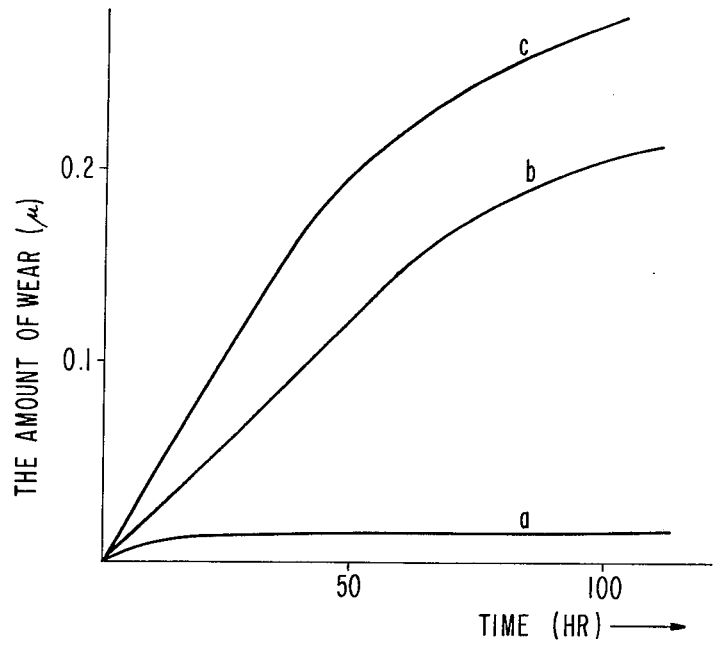
Figure 2:
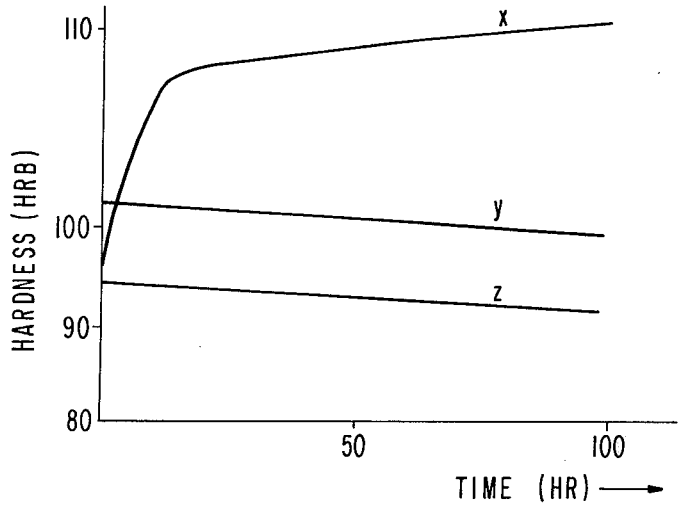

FIG. 1 depicts test results of a wear test comprising the sintered alloy of this invention 1, with a known high Cr cast iron 2 and a known ferrous sintered alloy 3, and FIG. 2 depicts test results of variation in hardness plotted against time for the sintered alloy of this invention *X*, a known high Cr cast iron *Y*, and a known ferrous sintered alloy, wherein curve *a* shows the change of the amount of wear the sintered alloy of this invention, curve *b* shows the change of the amount of wear of a known high Cr cast iron, curve *c* shows the change of amount of wear of a ferrous sintered alloy, curve *X* shows the change of the hardness of the sintered alloy of this invention, curve *Z* shows the change of the hardness of the ferrous sintered alloy and curve *Y* shows the change of the hardness of the Cr cast iron.

DETAILED EXPLANATION OF THE INVENTION

The sintered alloy of this invention having heat and wear resistances is produced by forming and sintering powdery mixture consisting of, in percent by weight, C:0.2 – 2.0%, Cr:2.0 – 9.9%, Mo:0.3 – 10.0%, W:0.5 – 5.0% with the balance, totaling 100 wt.%, being substantially Fe.

More particularly, the sintered alloy of this invention is produced by mixing 1.0 – 25.0 weight parts of a powder of alloy consisting of, in percent by weight, C:0.2 – 3%, Cr:20 – 70%, W:5 – 30% and Co:1.0 – 40% with 99.0 – 75.0 weight parts of basic powders of Fe, C, Mo and Co so that resulting powdery mixture consisting of, in percent by weight, C:0.2 – 2.0%, Cr:2.0 – 9.9%, Mo:0.3 – 1.5%, Co:3.0 – 10.0%, W:0.5 – 5.0% with the balance, totaling 100 wt.%, being substantially Fe is obtained, compacting the resulting powdery mixture with 3 – 7 ton/cm$^2$ pressure and sintering thus compacted mixture at 1,000° – 1,200°C for 30 – 60 min.

The amount of each component in the powder of alloy is restricted for the following reasons:

Less than 0.2% of C cannot fully form the carbides together with other elements, thus forming a sintered alloy having low hardness; the formation of the metal carbides are accelerated by the increase of the C content up to 3%, but more than 3% of C is not more effective for the carbide formation.

Cr forms the carbide together with C and W to increase the hardness of the sintered alloy in a range of 20 – 70% but more than 70% of Cr cannot increase the hardness and makes a brittle alloy. On the other hand, less than 20% of Cr is not effective to the formation of the carbide.

W forms also the complex carbide together with other elements to increase the hardness of the resultant alloy, but more than 30% of W increases the melting point of the alloy and injures the solubility. Less than 5% of W is not effective to the formation of the carbide.

Co increases the solubility of the alloy to facilitate the mutual alloying action, causes the tough matrix and stabilizes the hardness, but these effects are not expected below 1.0%. More than 40% of Co accelerates unwillingly the solubility and decreases the hardness.

The amount of each component in the finally resultant powdery mixture is restricted under the following reasons:

Less than 0.2% of C leads to a ferrite rich matrix which is not hard enough for high wear resistance, whereas more than 2% of C leads to a cementite high matrix of high hardness but causes an embrittlement on the resultant alloy. Besides, excess amount of C injures the workability and the uniform quality of the product.

Mo contributes to the strength and toughness of the alloy, i.e., increases the impact and fatigue resistance, and stabilizes the sintered structure, but these effects are not expected out of the range of 0.3 – 1.5%.

Co, which is known to stabilize a sintered structure at elevated temperature, functions as a medium between said powder of alloy and said basic powders, and increases the heat and wear resistance of the resultant sintered alloy, but more than 10% of Co is detrimental to workability. Less than 3% of Co is not effective to improve the heat and wear resistance.

The amount of Cr and that of W are restricted in the above described ranges in view of the structure and properties of the sintered product.

An addition of 0.5 – 5% of Ni or Cu is suitable for stabilizing or controlling the accuracy or the exactness of the resulting sintered product.

Ni contracts the sintered product; Cu expands the sintered product in the above restricted range. Less than 0.5% of Ni or Cu does not exhibit such volume controlling effect, whereas more than 5% of Ni or Co brings out the martensitic structure in part and injures the uniformity of the structure and hardness.

Now, more specific embodiments of this invention will be described with reference to some examples.

EXAMPLE 1

0.65 wt.% of graphite powder (−325 mesh), 0.5 wt.% of ferromolybdenum powder (−150 mesh) in percent by weight of molybdenum, 4.6 wt.% of Co powder (−325 mesh), 5 wt.% of a powder of alloy (−150 mesh) consisting of, in percent by weight, C:3.0%, Cr:60.0%, W:25.0% and Co:12.0%, with the balance, totaling 100 wt.%, being substantially the reduced iron powder (−100 mesh) were mixed to prepare the starting powdery mixture. 1 wt.% of zinc stearate powder as the lubricant was added to said starting powdery mixture, and thus obtained powdery mixture was compacted with 4 ton/cm$^2$ pressure and was successively sintered at 1,100° – 1,200°C in the decomposed ammonia gas atmosphere for 30 – 60 min.

The resulting sintered alloy was composed of, in percent by weight, C:0.78%, Cr:2.99%, Mo:0.47%, Co:5.01%, W:1.23% with the balance, totaling 100 wt.%, being substantially Fe, and exhibited the density of 6.62 g/cm$^3$ and the Rockwell B hardness of 92.5.

EXAMPLE 2

1.05 wt.% of graphite powder, 1.0 wt.% of ferromolybdenum powder in percent by weight of molybdenum, 6.2 wt.% of Co powder, 15.0 wt.% of the powder of alloy with the balance, totaling 100 wt.%, being substantially the reduced iron powder (these components had the same grain sizes and compositions as described in the Example 1) were mixed to prepare the starting powdery mixture. 1 wt.% of zinc stearate as the starting lubricant was added to said starting powdery mixture. Thus obtained powdery mixture was compacted with 6 ton/cm$^2$, pressure and was sintered in the decomposed ammonia gas atmosphere at 1,000° – 1,200°C for 30 – 60 min.

The resulting sintered alloy was composed of, in percent by weight, C:1.46%, Cr:8.93%, Mo:0.95%, Co:7.91%, W:3.74% with the balance, totaling 100 wt.%, being substantially Fe, and exhibited the density of 6.68 g/cm$^3$ and the Rockwell B hardness of 96.5.

EXAMPLE 3

Under the same conditions as described in the Example 2, a powdery mixture having the same composition as that in the Example 2 except for containing 5 wt.% of Ni and another powdery mixture having the same composition as that in the Example 2 except for containing 5 wt.% of Cu were prepared and subjected to the compacting and the sintering. The resulting sintered alloy containing Ni exhibited the density of 6.71 g/cm$^3$, and the Rockwell B hardness of 97.5, and the resulting inserted alloy containing Cu exhibited the density of 6.72 g/cm$^3$ and the hardness of 97.0.

Curves, *X*, *Y* and *Z* in the FIG. 2 show the results of the test for measuring the variations in hardness relative to the lapse of time on the sintered alloy of this invention, the known high Cr cast iron and the known ferrous sintered alloy, respectively. On the other hand, curves *a*, *b* and *c* in the FIG. 1 show the results of the test for measuring the wear loss of the sintered alloy of this invention, the known high Cr cast iron and the known ferrous sintered alloy, respectively. These two tests were carried out by using a valve seat abrasion tester (testing temperature 400°C, rotation number 3,000 r.p.m., spring pressure 35 kg, velocity of the valve at its closing period 0.5 m/sec., width of the valve contact surface 1 mm, test repeating number $8 \times 10^5$, mating alloy JIS SUH 31 B steel).

It will be apparent from the FIGS. 1 and 2 that the wear loss of the sintered alloy of this invention is extremely small and that the sintered alloy of this invention has a property that its hardness increases steeply relative to the lapse of time (10 – 20 hrs.). This means that the valve seat made of the sintered alloy of this invention, if mounted in the engine assembly which is actuated at a temperature of the usual automobile engine head (about 400°C), increases gradually its hardness relative to the lapse of the running time in spite of the low starting hardness and accordingly reduces its wear loss. Therefore, the valve seat made of the sintered alloy of this invention is very favorable in view of its durability.

The test specimen for the valve seat abrasion tester was shaped as a ring having the outer diameter of 40.0 mm., the inner diameter of 28.0 mm. and the height of 10.0 mm.

The known high Cr cast iron and the known ferrous sintered alloy described in aforesaid Examples had the composition and the hardness as follows:

THE KNOWN HIGH CR CAST IRON

Composition: C:1.61 wt.%, Cr:13.5 wt.%, Mo:0.47 wt.% with the balance, totaling 100 wt.%, being substantially Fe.

Rockwell B hardness: 102

THE KNOWN FERROUS SINTERED ALLOY

Composition: C:1.02 wt.%, Cr:2.76 wt.% with the balance, totaling 100 wt.%, being substantially Fe.

Rockwell B hardness: 94

While this invention has been described with reference to particular embodiments thereof, it will be understood that numerous modifications may be made by those skilled in the art without actually departing from the scope of this invention.

Therefore, the appended claims are intended to cover all such equivalent variations as coming within the true spirit and scope of this invention.

What is claimed is:

1. A valve seat formed of a sintered alloy comprising, in percent by weight, 0.2–2.0% carbon, 2.0–9.9% chromium, 0.3–1.5% molybdenum, 3.0–10.0% cobalt, 0.5–5.0% tungsten with the balance, totalling 100 weight percent, being substantially Fe, said carbon being present as carbides of other elements in said alloy and said chromium forming carbide with carbon and tungsten in said alloy.

* * * * *